US011305970B2

(12) United States Patent
Borøy et al.

(10) Patent No.: US 11,305,970 B2
(45) Date of Patent: Apr. 19, 2022

(54) METHOD OF UPGRADING A KNUCKLE-BOOM CRANE AND A HEAVE-COMPENSATING CRANE

(71) Applicant: National Oilwell Varco Norway AS, Kristiansand (NO)

(72) Inventors: Yngvar Borøy, Søgne (NO); Thor Strand, Kristiansand (NO); Adrian Orasanu, Kristiansand (NO); Ricardo Nuno Correia, Kristiansand (NO)

(73) Assignee: National Oilwell Varco Norway AS

( * ) Notice: Subject to any disclaimer, the term of this patent is extended or adjusted under 35 U.S.C. 154(b) by 47 days.

(21) Appl. No.: 16/344,635

(22) PCT Filed: Sep. 6, 2017

(86) PCT No.: PCT/EP2017/072351
§ 371 (c)(1),
(2) Date: Apr. 24, 2019

(87) PCT Pub. No.: WO2018/082831
PCT Pub. Date: May 11, 2018

(65) Prior Publication Data

US 2020/0062554 A1 Feb. 27, 2020

(30) Foreign Application Priority Data

Nov. 3, 2016 (EP) ..... 16197082

(51) Int. Cl.
*B66C 13/10* (2006.01)
*B66C 23/00* (2006.01)
(Continued)

(52) U.S. Cl.
CPC ..... *B66C 13/10* (2013.01); *B66C 13/105* (2013.01); *B66C 23/54* (2013.01); *B63B 27/10* (2013.01); *B66C 23/52* (2013.01); *B66D 1/52* (2013.01)

(58) Field of Classification Search
CPC ..... B66C 23/08; B66C 23/42; B66C 23/52; B66C 23/54; B66C 23/68; B66C 13/02;
(Continued)

(56) References Cited

U.S. PATENT DOCUMENTS 9,108,825 B2 * 8/2015 Kjolseth ..... B66C 13/02
2009/0232625 A1 9/2009 Almeda
(Continued)

FOREIGN PATENT DOCUMENTS

DE 102012010644 A1 * 12/2013 ..... B66C 23/52

OTHER PUBLICATIONS

Machine Translation of DE 102012010644 (Year: 2013).*
(Continued)

*Primary Examiner* — Michael R Mansen
*Assistant Examiner* — Juan J Campos, Jr.
(74) *Attorney, Agent, or Firm* — Conley Rose, P.C.

(57) ABSTRACT

A method of upgrading a knuckle-boom crane to a heave-compensating crane includes: removing a knuckle-boom from a main boom; mounting a main boom extension to the main boom for increasing the length of the main boom; and mounting a heave-compensating boom at a far end of the main boom extension such that the heave-compensating boom extends in a downward vertical direction (Z) in operational use of the heave-compensating crane. The heave-compensating boom is configured to be pivotable with respect to the main boom extension in both horizontal directions (X, Y). A heave-compensation system is provided to the knuckle-boom crane, wherein the heave-compensa-
(Continued)

tion system compensates for horizontal variations by controlling the orientation of the heave-compensating boom relative to the main boom extension, and compensates for vertical variations by means of a further vertical heave-compensation system, such as a winch-based heave-compensation system.

27 Claims, 11 Drawing Sheets

(51) Int. Cl.
*B66D 1/52* (2006.01)
*B63B 27/10* (2006.01)
*B66C 23/52* (2006.01)

(58) Field of Classification Search
CPC ..... B66C 13/10; B66C 13/105; B63B 27/10; B66D 1/52
See application file for complete search history.

(56) References Cited

U.S. PATENT DOCUMENTS

2010/0089855 A1* 4/2010 Kjolseth ..... B66C 13/02 212/276
2010/0230370 A1* 9/2010 Schneider ..... B66C 23/52 212/276
2012/0282064 A1* 11/2012 Payne ..... F03B 13/264 414/139.6
2014/0001140 A1* 1/2014 Wimmer ..... B66C 23/705 212/299
2016/0152451 A1* 6/2016 Vestre ..... B66D 1/08 212/291

OTHER PUBLICATIONS

Written Opinion for PCT/EP2017/072351 dated Nov. 22, 2017(7 pages).
International Search Report for PCT/EP2017/072351 dated Nov. 22, 2017 (3 pages).
Extended European Search Report for EP 16197082.7 dated May 17, 2017 (7 pages).

* cited by examiner

METHOD OF UPGRADING A KNUCKLE-BOOM CRANE AND A HEAVE-COMPENSATING CRANE

CROSS REFERENCE TO RELATED APPLICATIONS

This application is a 35 U.S.C. § 371 national stage application of PCT/EP2017/072351 filed Sep. 6, 2017 and entitled "Method of Upgrading a Knuckle-Boom Crane and a Heave-Compensating Crane", which claims priority to European Patent Application No. 16197082.7 filed Nov. 3, 2016, each of which is incorporated herein by reference in their entirety for all purposes.

STATEMENT REGARDING FEDERALLY SPONSORED RESEARCH OR DEVELOPMENT

Not applicable.

FIELD OF THE INVENTION

The invention relates to a method of upgrading a knuckle-boom crane to a heave-compensating crane. The invention further relates to a heave-compensating crane as such, particularly a 3D heave-compensating crane.

BACKGROUND OF THE DISCLOSURE

Motion- or heave-compensating cranes on vessels as such are already known for many decades. Some systems are configured for manipulating the position and orientation of (part of) the arms of the crane to compensate for motion or heaves (X, Y, and Z-direction also called 3D-heave-compensation). Other systems are configured for only compensating in the vertical direction (Z-direction, also called 1D-heave-compensation). Many of those systems focus on the winch system, i.e. they control the winch in order to compensate for variations in the Z-direction due to heaves. Not so long ago so-called distal end 3D-heave-compensation systems were reported, two of them are described below.

WO2015/199543A1 discloses a positioning system having a positioning arm with a distal end for positioning a target relative to a reference point, wherein the distal end of the positioning arm and/or the reference point may be subject to undesired motion caused by external factors, such as waves of the sea. The distal end of the positioning arm is provided with an end effector and a motion-compensation actuator being a parallel robot, such as delta robot, coupled between the distal end of the positioning arm and the end effector, wherein the motion-compensation actuator is configured for reducing undesired motion of the end effector relative to the reference point. This document further discloses a crane for use on a vessel comprising such positioning system.

U.S. Pat. No. 9,108,825B2 discloses a method of controlling a crane and a manipulator including determining the relative motion between a first platform including the crane and a second platform, determining the current position of the manipulator, and repositioning the manipulator to compensate for the relative motion between the first platform and the second platform and in accordance with operator commands. The manipulator is mounted at the end of the jib and is designed to compensate motion for three position degrees of freedom.

It is known that distal end 3D-heave-compensation systems are not suitable for heavy-duty hoisting (loads that weigh well over 50 T).

SUMMARY OF THE DISCLOSURE

The disclosure offers a means to remedy or to reduce at least one of the drawbacks of the prior art, or at least provide a useful alternative to prior art.

The is achieved through features, which are specified in the description below and in the claims that follow.

In a first aspect the disclosure relates to a method of upgrading a knuckle-boom crane to a heave-compensating crane. The method comprises:

- providing a knuckle-boom crane having a crane base, a main boom pivotably mounted to the crane base, and a knuckle-boom pivotably mounted to the main boom;
- removing the knuckle-boom from the main boom;
- mounting a main boom extension to the main boom for increasing the length of the main boom;
- mounting a heave-compensating boom at a far end of the main boom extension such that the heave-compensating boom extends in a downward vertical direction in operational use of the heave-compensating crane, wherein the heave-compensating boom is configured to be pivotable with respect to the main boom extension in both horizontal directions defined with respect to the downward vertical direction, and
- providing a heave-compensation system to the knuckle-boom crane, wherein the heave-compensation system is configured for compensating for horizontal variations by controlling the orientation of the heave-compensating boom relative to the main boom extension, and for compensating the vertical variations by means of a further vertical heave-compensation system, such as a winch-based heave-compensation system.

In order to facilitate understanding of the disclosure one or more expressions are further defined hereinafter.

Wherever the wording "knuckle-boom" is used, this is interpreted to be the movable arm connected to the first (main) arm of the crane. Throughout literature this part is also called: "jib".

Wherever the wording "winch-based heave-compensation system" is used, this refers to a heave-compensation system that controls the winch system to compensate for vertical variations. With "winch system" it is not necessarily meant that the winch is controlled to compensate for the vertical variations. It may also be that there is a bending point, such as a sheave system, which controls the length of the cable path from the main winch to the top-sheave of the crane, for example. Such sheave system may comprises a cylinder compensator, which may be a linear compensator, either hydraulic or electric.

As described herein, a knuckle-boom crane is modified such that the knuckle-boom (also being referred to as a jib) is replaced with a main-boom extension and a heave-compensating boom that is substantially oriented downwards. The main-boom extension not only increases the reach of the crane, it also effectively creates "the room" for the heave-compensating boom to be extending downwards from the far end of the main-boom extension, in particular when the main boom is in an erected position (positioned under an angle with the horizon). This is in contrast with the solution presented in U.S. Pat. No. 9,108,825B2, where they placed the manipulator at the end of the jib.

A further feature is that method of the disclosure ensures that the heave-compensating boom is extending in a downward direction and that the heave-compensation system is configured for compensating horizontal variations by controlling the orientation of the heave-compensating boom relative to the main boom (extension), while at the same time compensating the vertical variations by means of a further vertical heave-compensation system that is, for example, winch-based. This is in contrast with the solution presented in U.S. Pat. No. 9,108,825B2, where the manipulator also serves to compensate for the vertical variations, and moreover, effectively the whole crane is used to compensate for heaves. This basically means that the heave-compensating system of U.S. Pat. No. 9,108,825B2 is divided in three sections: main boom, knuckle boom and manipulator with 3 hinge points (instead of two in the current disclosure), which means that the prior art solution has more bends. Such solution is very disadvantageous, because this reduces the weight motion-compensating capacity in the other directions (X and Y) of the system significantly. The disclosure, on the other side, leaves the vertical variations to the further vertical heave-compensation system, which maximizes the motion compensation capacity and speed of the heave-compensating boom for the X and Y directions. Having a separate winch-based system for the Z-variations effectively renders it possible to inject much more energy into the motion compensation system. Expressed differently, at large weights of the load (i.e. in the range from 100 T to 400 T (or maybe even bigger, namely up to 1000 T for a two-part system or parallel wire system), the heave-compensating crane disclosed herein provides for a better heave-compensation.

In fact, a heave-compensating boom (also being referred to as the "3D compensator") may be used on all types of offshore cranes, such as knuckle boom crane, lattice boom cranes, telescopic boom cranes, and box boom cranes, either new or upgraded ones.

In an embodiment of the method in accordance with the disclosure, in the step of mounting the main boom extension, the main boom extension comprises a top-sheave at its far end (near the heave-compensating boom, also called rotating lever). In this embodiment, the top-sheave in the main-boom extension takes the role from the sheave that was previously located at the end of the knuckle-boom.

In an embodiment of the method in accordance with the disclosure, in the step of mounting the heave-compensating boom, the heave-compensating boom comprises a hoisting cable guiding system for cooperating with the top-sheave. Since the heave-compensating boom is pivoted in both X and Y directions for compensating the position variations in these directions, the hoisting cable is preferably guided by a guiding system, such that the hoisting cable will follow the movements of the heave-compensating boom.

In an embodiment of the method in accordance with the disclosure, in the step of mounting the heave-compensating boom, the hoisting cable guiding system comprises a pair of sheaves mounted on a rotatable head provided at the far end of the heave-compensating boom. The pair of sheaves (arranged in line with each other, rolling over each other) form a convenient way of guiding a cable, in particular when the cable is bent within the vertically-oriented plane of the sheaves. By providing these sheaves on a rotatable head they can also be used to guide the cable when it is bent over other planes, which cut the earlier-mentioned oriented plane (i.e. being effectively rotated versions of this plane).

In an embodiment of the method in accordance with the disclosure, in the step of mounting the heave-compensating boom, the heave-compensating boom comprises a first arm that is pivotably mounted to the main boom extension for allowing a rotation in a first horizontal direction, the heave-compensating boom further comprising a second arm that is pivotably mounted to the first arm for allowing a rotation in a second horizontal direction orthogonal to the first horizontal direction.

In an embodiment of the method in accordance with the disclosure, in the step of mounting the heave-compensating boom, the first arm is mounted such that it extends in a substantially horizontal direction in operational use of the heave-compensating crane, and the second arm is mounted such that it extends in the downward vertical direction in operational use of the heave-compensating crane. This embodiment, first of all, conveniently enables the heave-compensating boom to be pivoted in two directions (X and Y). Moreover, the first arm could be also used to manipulate the position of the Z-axis. In practical embodiments this arm will be kept relatively short.

In an embodiment of the method in accordance with the disclosure, in the step of mounting the heave-compensating boom, said first and second arms are provided with electric or hydraulic actuators to control respective orientations of said arms. The use of electric and hydraulic actuators are known techniques to actuate the arms or booms in a crane, each of these techniques having their own advantages and disadvantages.

An embodiment of the method in accordance with the disclosure, further comprises completion steps of completing the heave-compensating crane for making it ready for operational use, wherein the completion steps comprise: i) the installation of a hoisting cable (also called lifting wire) along the main boom, main boom extension and the heave-compensating boom, and ii) the installation of reinforcements to hold the main boom and heave-compensating boom in place.

In a second aspect the disclosure relates to a heave-compensating crane comprising:

- a crane base;
- a main boom pivotably mounted to the crane base;
- a heave-compensating boom pivotably mounted at a far end of the main boom, wherein the heave-compensating boom extends in a downward vertical direction in operational use of the heave-compensating crane, wherein the heave-compensating boom is configured to be pivotable with respect to the main boom in both horizontal directions defined with respect to the downward vertical direction, and
- a heave-compensation system configured for compensating for horizontal deviations by controlling the orientation of the heave-compensating boom relative to the main boom, and for compensating the vertical deviations by means of a further vertical heave-compensation system, such as a winch-based heave-compensation system.

Even though the method of the disclosure conveniently allows for the upgrading of an existing knuckle-boom crane towards heave-compensating crane, the disclosure also discloses a heave-compensating crane as such. Such heave-compensating-crane does not necessarily have to be made with the method of the disclosure, i.e. it could be made from scratch. That means that instead of extending the main boom of an existing knuckle-boom crane, a longer main boom is manufactured and mounted to the crane base. Alternatively, a traditional main boom of a knuckle-boom could be taken and be extended with a main boom extension as explained with reference to the method of upgrading in accordance with the disclosure. In any case, wherever the wording "main boom extension" is written in the method claims, in the device claim this has been replaced with "main boom" for the reason that the main boom extension is purely an extension of the main boom effectively rendering the function the same as that of the main boom. This crane follows the same effects and advantages as discussed concerning the method of the disclosure.

In an embodiment of the crane in accordance with the disclosure the main boom comprises a top-sheave at its far end. This embodiment follows the same effects and advantages as discussed concerning the corresponding embodiment of the method in accordance with the disclosure.

In an embodiment of the crane in accordance with the disclosure the heave-compensating boom comprises a hoisting cable guiding system for cooperating with the top-sheave. This embodiment follows the same effects and advantages as discussed concerning the corresponding embodiment of the method in accordance with the disclosure.

In an embodiment of the crane in accordance with the disclosure the hoisting cable guiding system comprises a pair of sheaves mounted on a rotatable head provided at the far end of the heave-compensating boom. This embodiment follows the same effects and advantages as discussed concerning the corresponding embodiment of the method in accordance with the disclosure.

In an embodiment of the crane in accordance with the disclosure the heave-compensating boom comprises a first arm that is pivotably mounted to the main boom for allowing a rotation in a first horizontal direction. The heave-compensating boom further comprises a second arm that is pivotably mounted to the first arm for allowing a rotation in a second horizontal direction orthogonal to the first horizontal direction. This embodiment follows the same effects and advantages as discussed concerning the corresponding embodiment of the method in accordance with the disclosure.

In an embodiment of the crane in accordance with the disclosure the first arm is mounted such that it extends in a substantially horizontal direction in operational use of the heave-compensating crane, and the second arm is mounted such that it extends in the downward vertical direction in operational use of the heave-compensating crane. This embodiment follows the same effects and advantages as discussed concerning the corresponding embodiment of the method in accordance with the disclosure.

In an embodiment of the crane in accordance with the disclosure said first and second arms are provided with electric or hydraulic actuators to control respective orientations of said arms. This embodiment follows the same effects and advantages as discussed concerning the corresponding embodiment of the method in accordance with the disclosure.

In an embodiment of the crane in accordance with the disclosure the crane further comprises a hoisting cable along the main boom and the heave-compensating boom. This embodiment follows the same effects and advantages as discussed concerning the corresponding embodiment of the method in accordance with the disclosure.

BRIEF INTRODUCTION OF THE DRAWINGS

In the following is described examples of embodiments illustrated in the accompanying drawings, wherein.

Figure 15A:
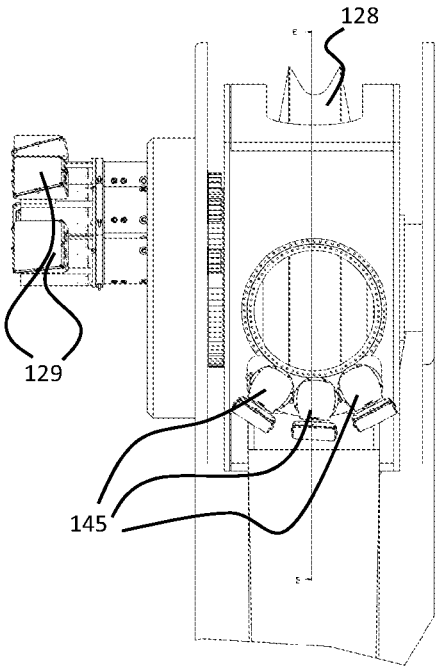
Figure 15B:
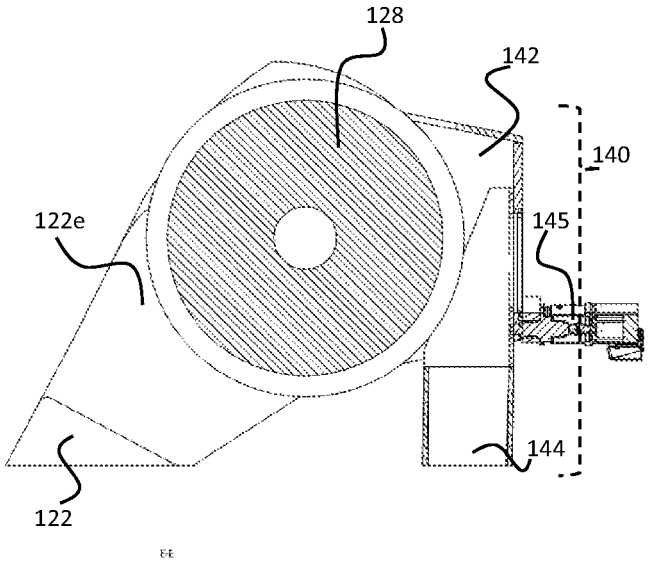

FIG. 15*a* shows an enlarged front view of the far-end of the main boom extension of the crane;

FIG. 15*b* shows a cross-sectional view of FIG. 15*b;*

Figure 16A:
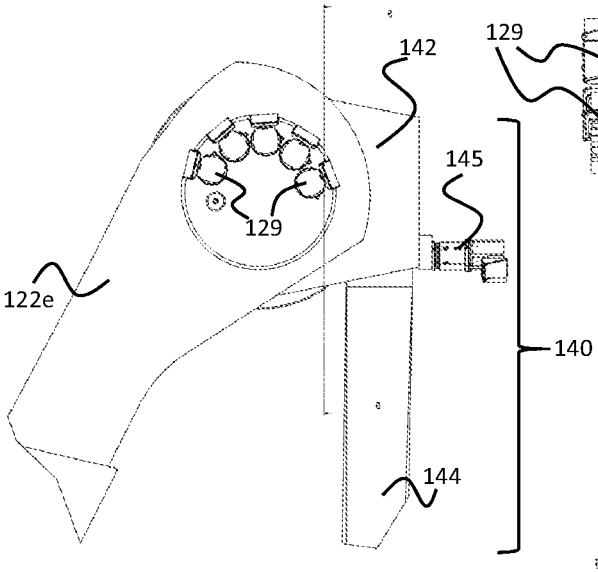
Figure 16B:
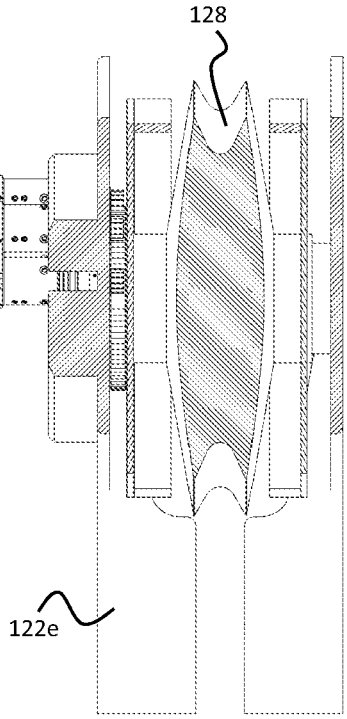

FIG. 16*a* shows an enlarged side view of the far-end of the main boom extension of the crane;

FIG. 16*b* shows a further cross-sectional view of FIG. 16*a*, and

Figure 17:
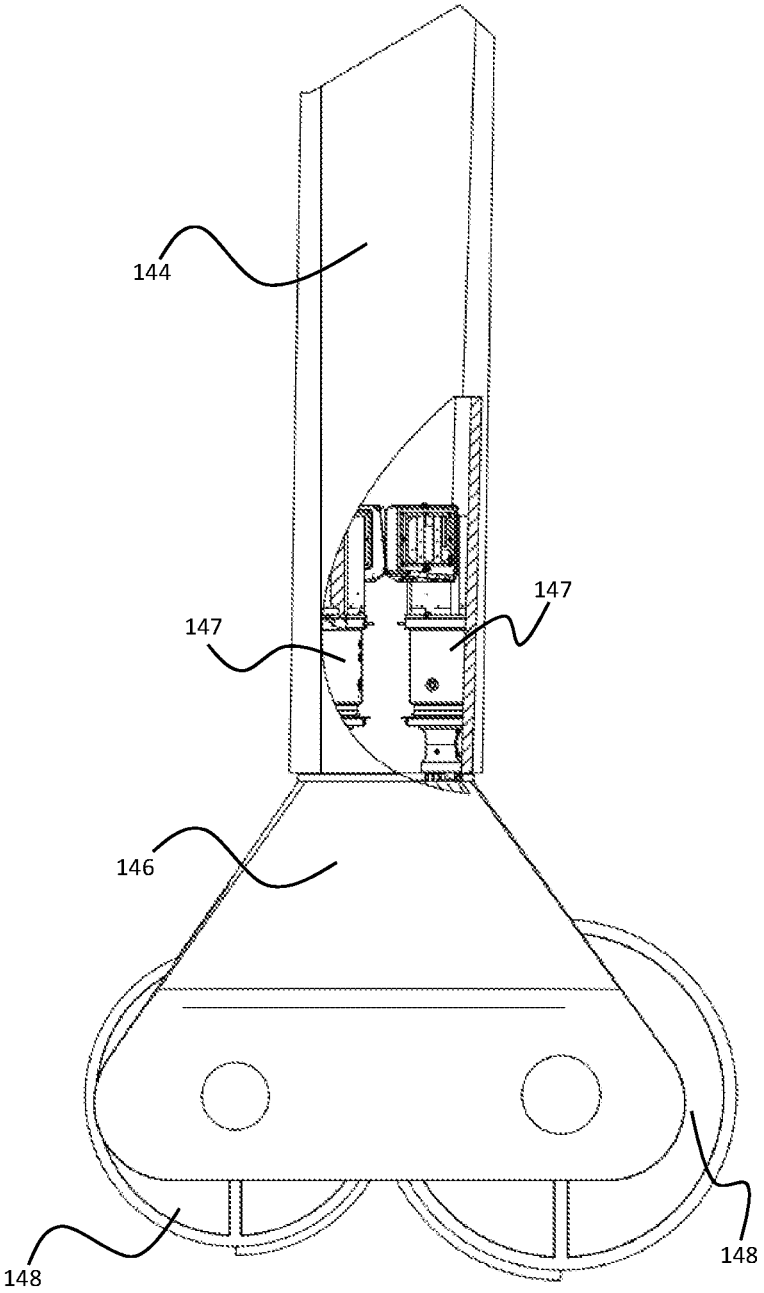

FIG. 17 shows an enlarged view of the tip of the heave-compensating boom of the crane.

DETAILED DESCRIPTION OF THE DISCLOSED EXEMPLARY EMBODIMENTS

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers'specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 1:
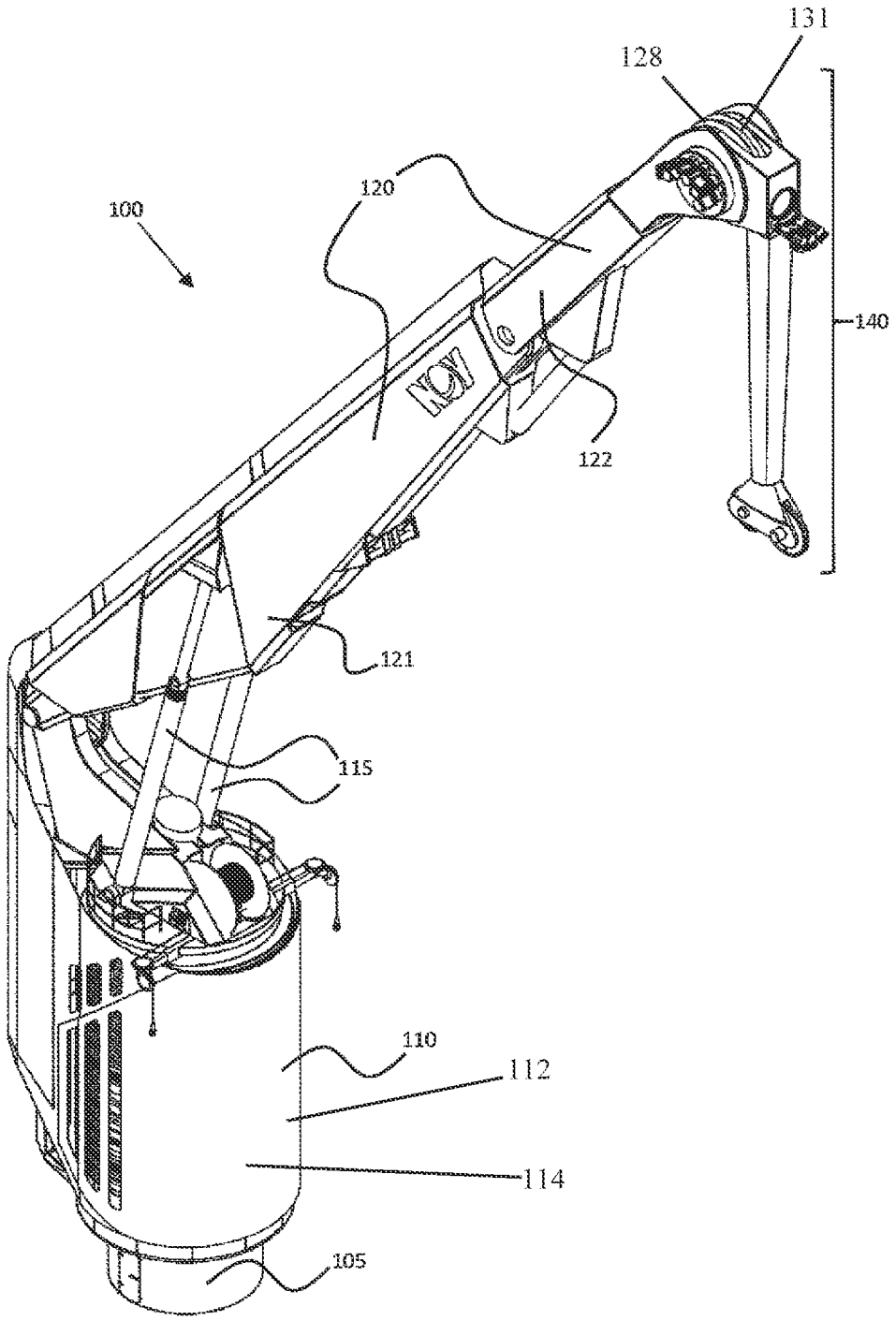
FIG. 1 shows a knuckle-boom crane that has been upgraded to a heave-compensating crane.

FIG. 1 shows a knuckle-boom crane that has been upgraded to a heave-compensating crane 100. The heave-compensating crane 100 in this embodiment is the result of an up-grade of an existing knuckle-boom crane, which will be explained with reference to FIGS. 2-12. The heave-compensating crane 100 comprises a crane base 110 that is rotatable mounted on a crane pedestal 105. The crane pedestal 105 is typically mounted in the deck of a ship (not shown). The crane base 110 comprises a main winch system 112, which comprises heave-compensated winch system 114, such as an active heave-compensation (AHC) winch system, in order to take care of variations in the Z-direction. Heave-compensated winch system 114 may also be referred to herein as a further or second heave-compensation system 114 comprising the winch system 112. On the crane base 110 there is pivotably mounted a main boom 120 that is actuated via main boom actuators 115 as shown. All construction and operation aspects of a crane are considered to be well known to the person skilled in the art and will therefore not be discussed in more detail here. The main boom 120 of the crane comprises an original main boom 121 of a knuckle-boom crane and a main boom extension 122. At the end of the main-boom extension 122 there is mounted a heave-compensating boom 140, which forms an important part of the embodiment shown. This heave-compensating boom 140 provides for an additional heave-compensation system, next to the AHC system, and is configured for compensating for variations in the X-direction and Y direction.

FIGS. 2-12 show different stages of the method of upgrading a knuckle-boom crane to a heave-compensating crane in accordance with the disclosure. In the discussion of these figures only the differences with respect to the previous figure are discussed.

Figure 2:
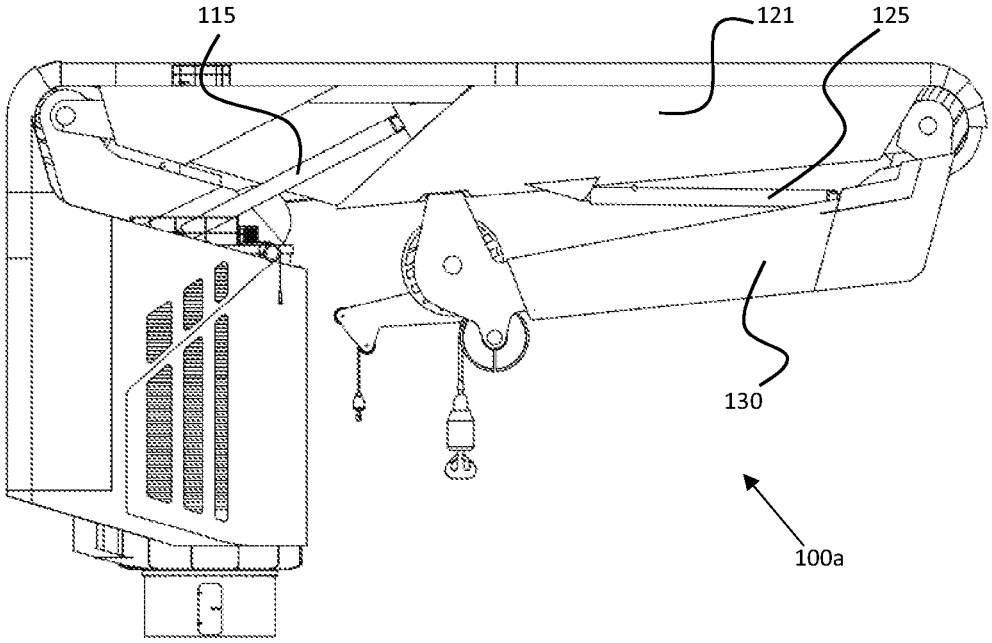
FIGS. 2-12 show different stages of a method of upgrading a knuckle-boom crane to a heave-compensating crane in accordance with the disclosure.

FIG. 2 shows a first stage of the method, wherein a knuckle-boom crane 100*a* is provided. The knuckle-boom crane 100*a* comprising a main boom 121 and knuckle-boom 130 (also called jib) that has been folded in. The figure also shows the main boom actuators 115 and the knuckle-boom actuator 125.

Figure 3:
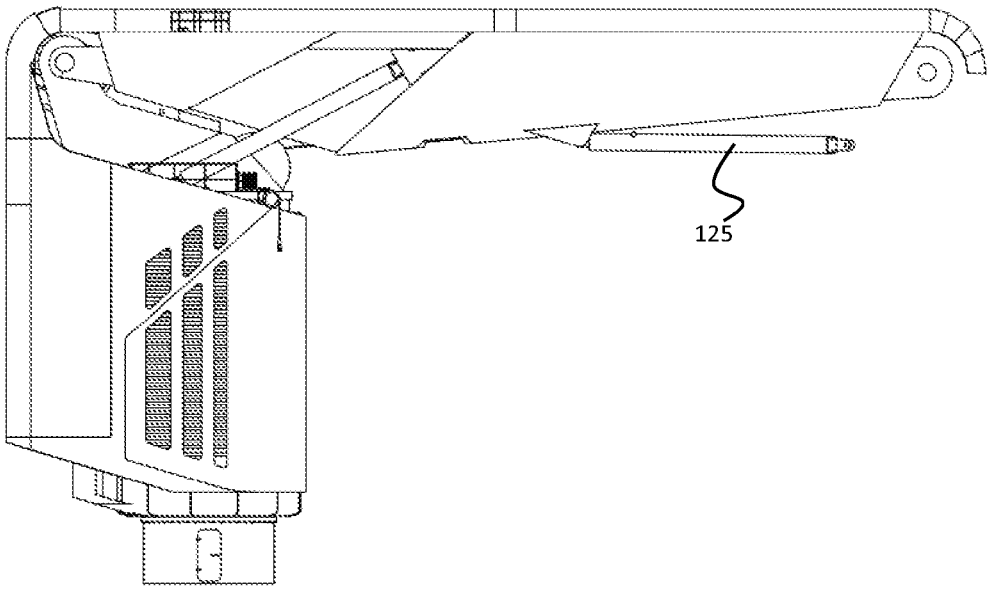

FIG. 3 shows a further stage of the method, wherein the knuckle-boom 130 (and all parts connected to it) has been removed.

Figure 4:
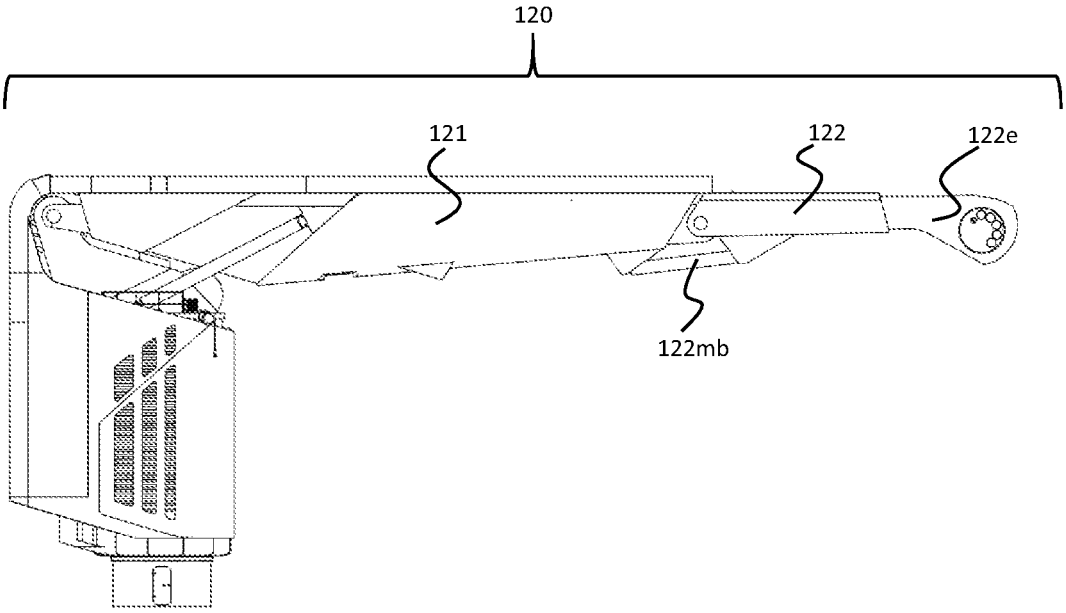

FIG. 4 shows another stage of the method, wherein the main boom 121 is extended with a main boom extension 122. In this embodiment the main boom extension 122 is mounted to the pivoting point or axle of the original main boom 121, wherein a mounting bar or joint 122*mb* is provided at the position where originally the actuator 125 was located. However, it must be stressed that other constructions and solutions are also possible to lengthen the main boom 120 as illustrated. The main boom extension 122 also comprises a far end 122*e* that is prepared to receive a heave-compensating boom later in the process.

Figure 5:
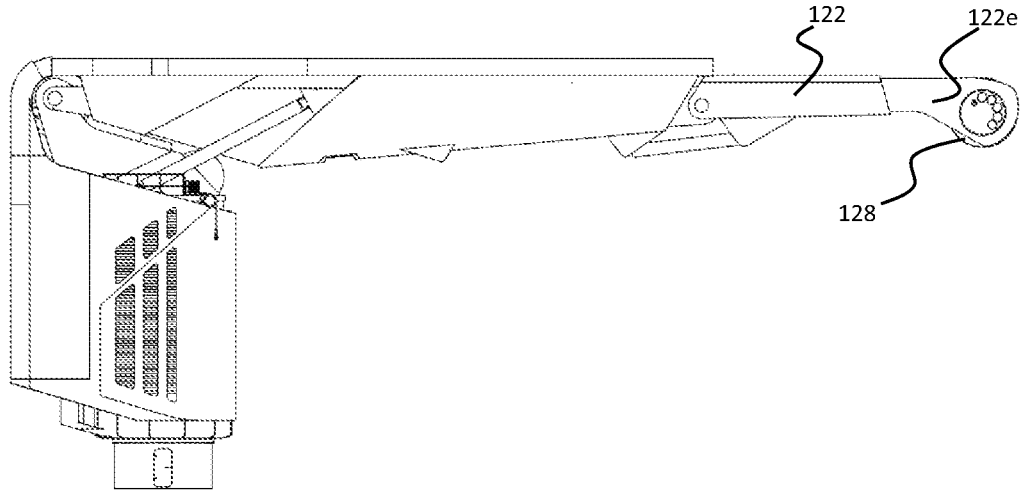

FIG. 5 shows another stage of the method, wherein a top-sheave 128 is rotatably mounted in the far end 122*e* of the main boom extension 122.

Figure 6:
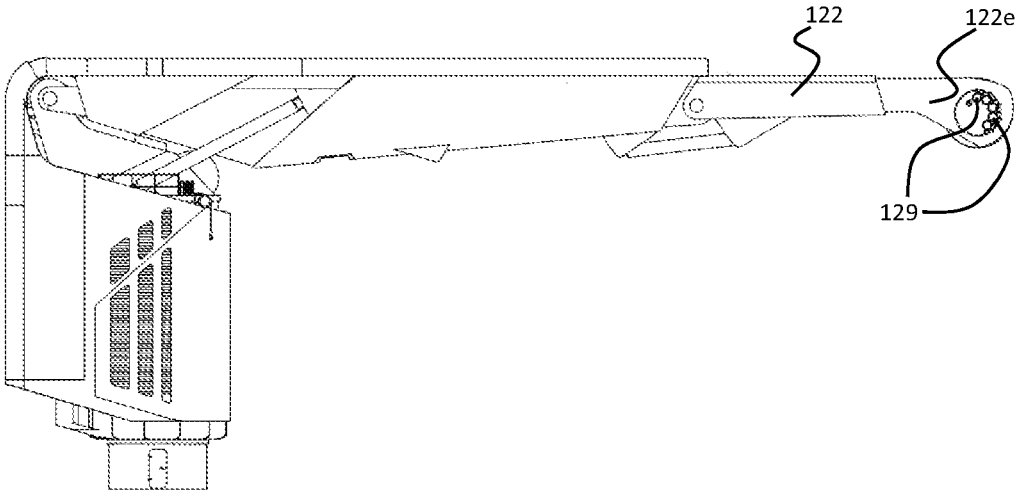

FIG. 6 shows another stage of the method, wherein first arm actuators 129 are mounted on the far end 122*e* of the main boom extension 122. Said actuators 129 serve to actuate the first arm of heave-compensating boom to be mounted, and are therefore referred to as first-arm actuators 129. These first-arm actuators 129 are also referred to as "rotating lever actuators". The operation and function of these actuators is considered to be well-known as such and therefore not illustrated or discussed in further detail.

Figure 7:
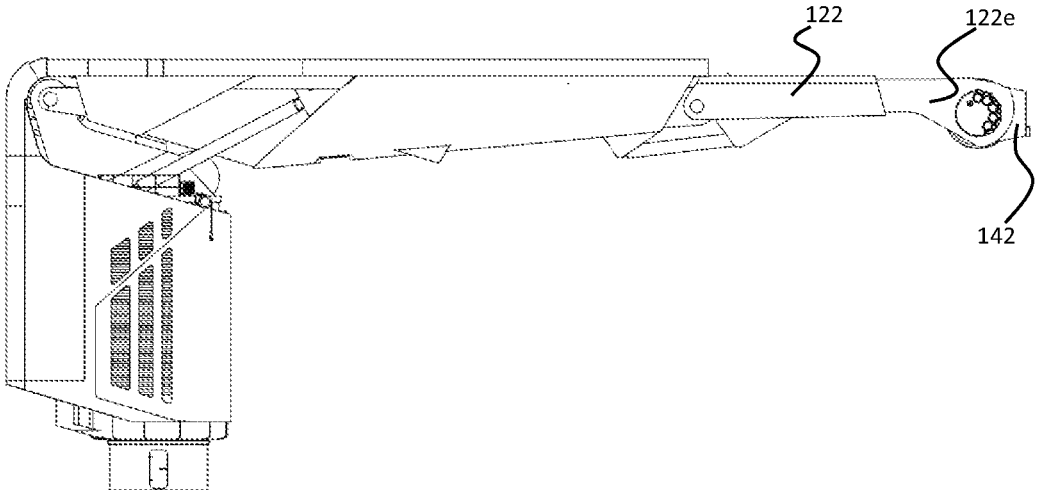

FIG. 7 shows another stage of the method, wherein the first arm 142 of the heave-compensating boom is pivotably mounted at the far end 122*e* of the main boom extension 122. The first arm 142 is also referred to as "rotating lever"

Figure 8:
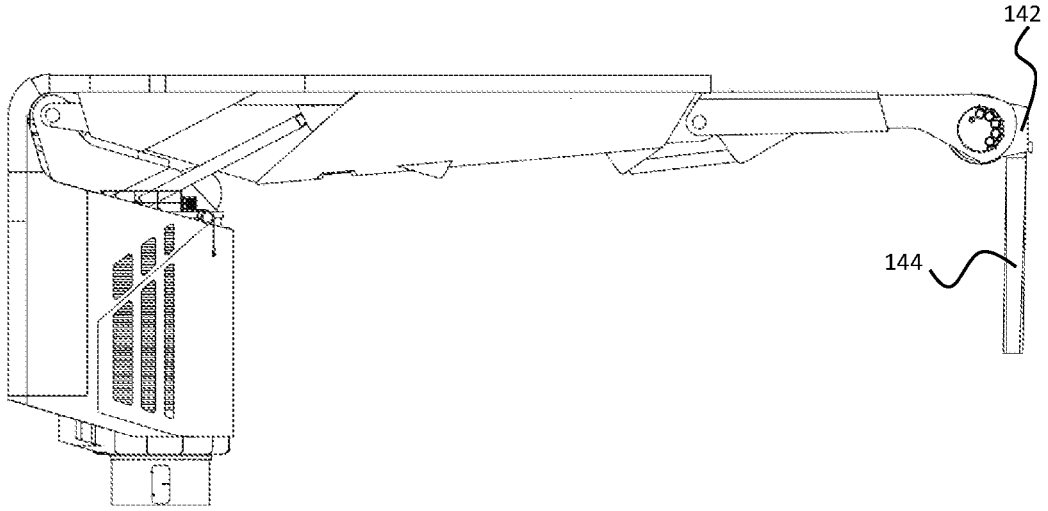

FIG. 8 shows another stage of the method, wherein a second arm 144 of the heave-compensating boom is pivotably mounted to the first arm 142. The second arm 144 is also referred to as "pivot boom".

Figure 9:
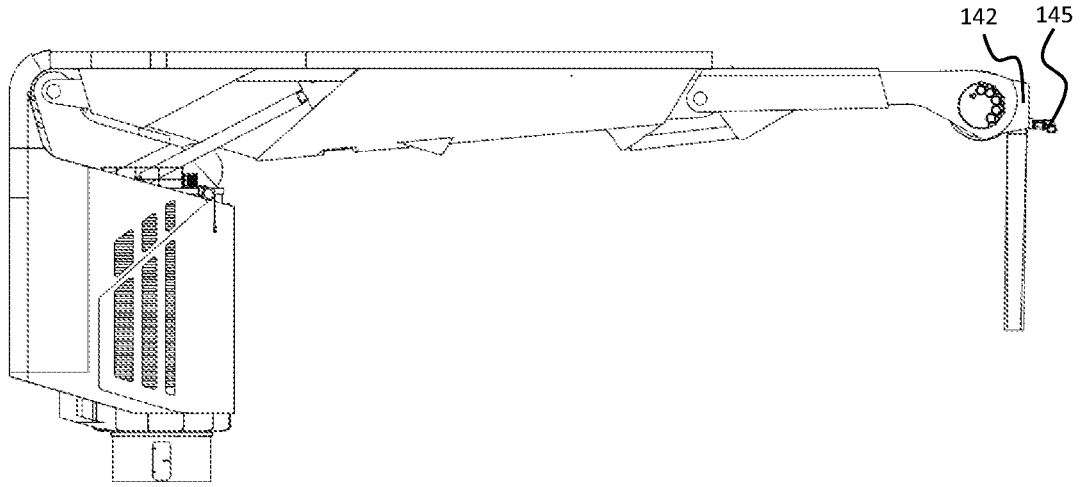

FIG. 9 shows another stage of the method, wherein second arm actuators 145 are mounted on the first arm 142. Both the first arm actuators 129 as well as the second arm actuators 145 may be electric or hydraulic actuators. The second arm actuators 145 are also referred to as "pivot boom actuators". The operation and function of these actuators is considered to be well-known as such and therefore not illustrated or discussed in further detail.

Figure 10:
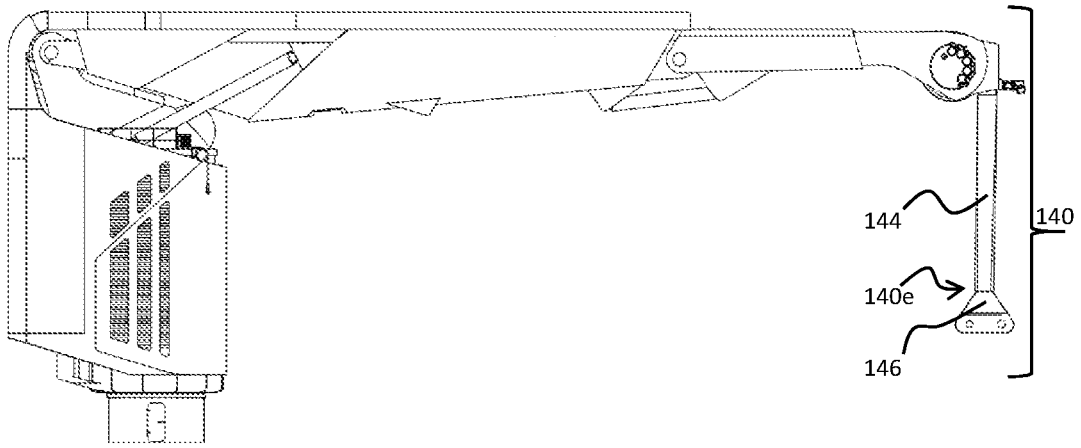

FIG. 10 shows another stage of the method, wherein a rotatable head 146 is mounted at a far end 140*e* of the second arm 144 of the heave-compensating boom 140 as illustrated. The rotatable head 146 is configured for receiving a pair of in-line oriented sheaves (not shown) for guiding a hoisting cable 131, shown in FIG. 1 disposed along top sheave 128.

Figure 11:
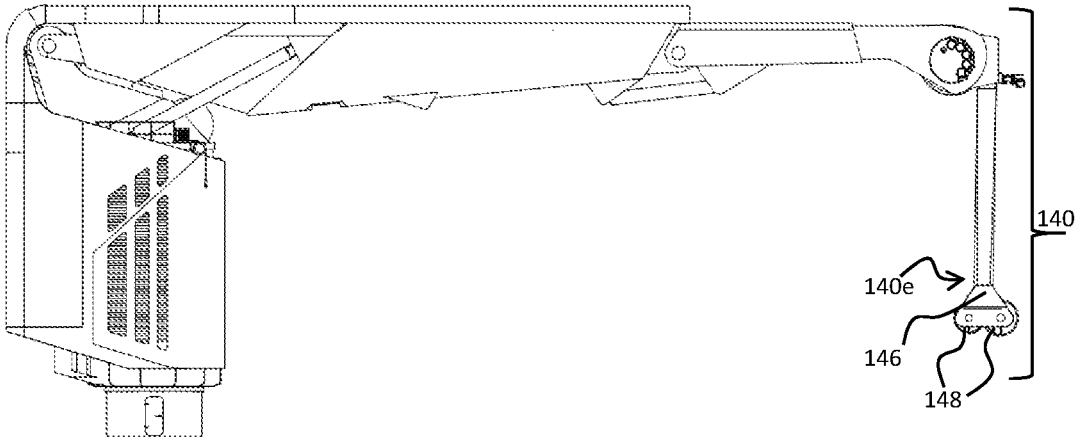

FIG. 11 shows another stage of the method, wherein the pair of sheave 148 is mounted in the rotatable head 146. This step effectively completes the heave-compensating boom 140.

Figure 12:
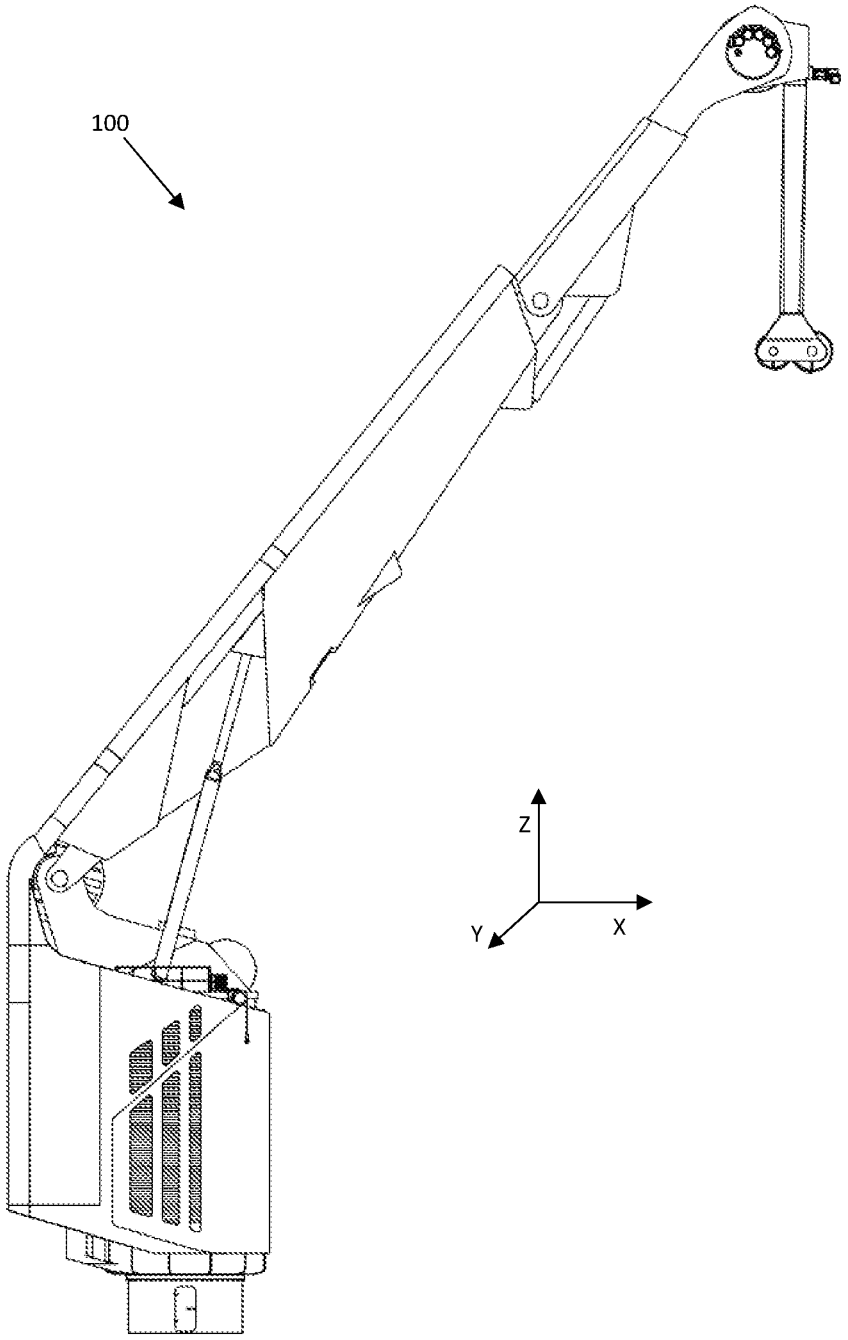

FIG. 12 shows another stage of the method, where the heave-compensating crane 100 is almost completed. The only thing missing in the figure is the hoisting cable. The figure further serves to define the different directions (for heave-compensation), planes and orientation to which reference is made throughout the claims and the description. The first horizontal direction is defined in the direction of the arrow indicated with X. This is referred to as X-direction, but in other places also reference is made to the X-plane, which is then defined as the plane defined by the X and Z arrows. The second horizontal direction is defined orthogonal to the X-direction and indicated by the arrow indicated with Y. This is referred to as Y-direction, but in other places also reference is made to the Y-plane, which is then defined as the plane defined by the Y and Z arrows. The third direction is the vertical direction and defined in the direction of the arrow indicated with Z. This is referred to as Z-direction.

Figure 13:
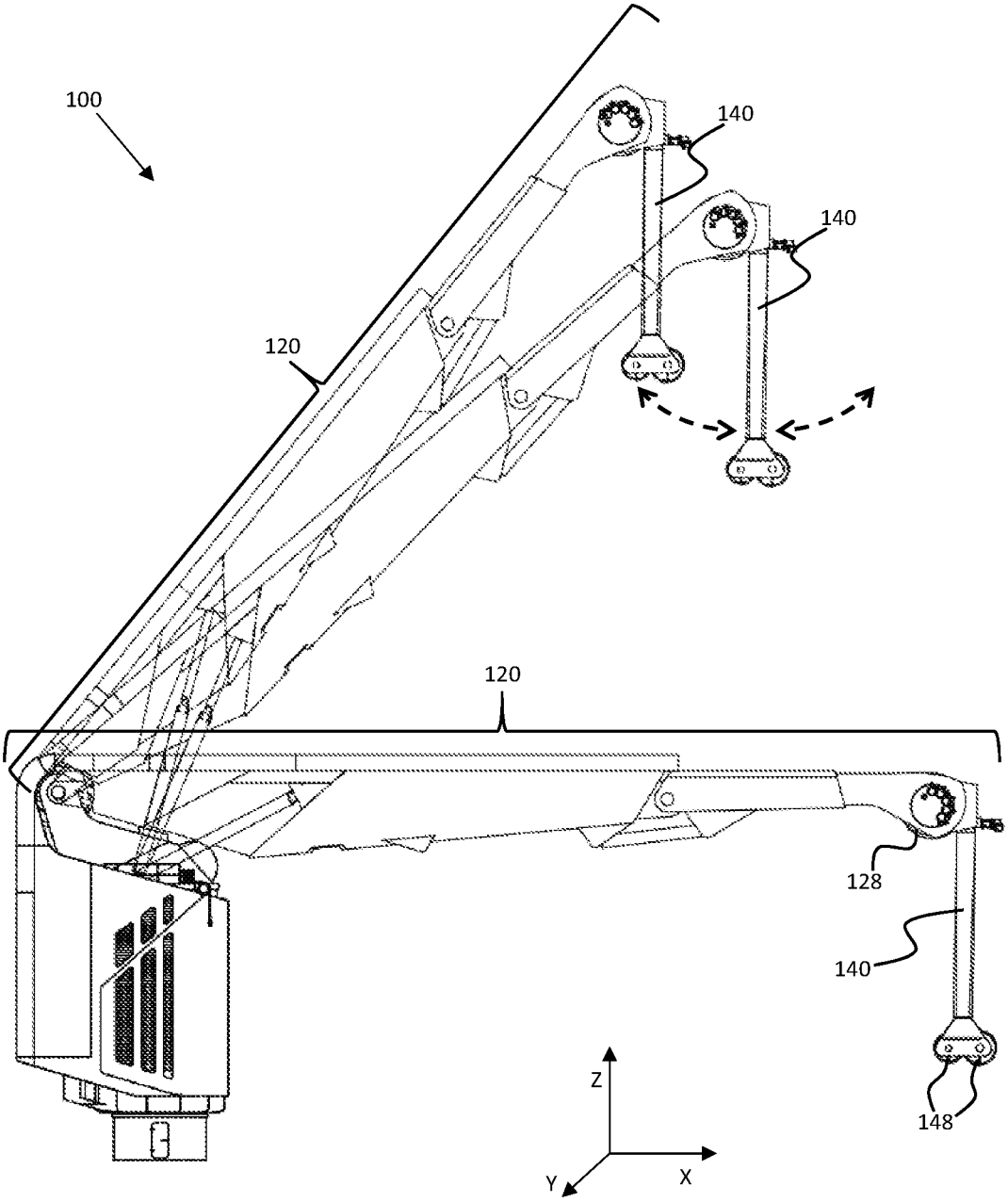
FIG. 13 illustrates a first aspect of the operation of the heave-compensated crane.

FIG. 13 illustrates a first aspect of the operation of the heave-compensated crane. This figure serves to illustrate the movement of the main boom 120 and how the heave-compensating boom 140 is constantly directed in a downward direction during this movement. However, the heave-compensating boom 140 can be actuated in the directions of the arrows within the X-plane to compensate for position variations in the X-direction due to heaves. During these movements of the heave-compensating boom 140 the hoisting cable (not shown) is properly guide by the sheaves 128, 148. The maximum angle over which the heave-compensating boom needs to be pivoted is typically 20 degrees with respect to the vertical direction Z.

Figure 14:
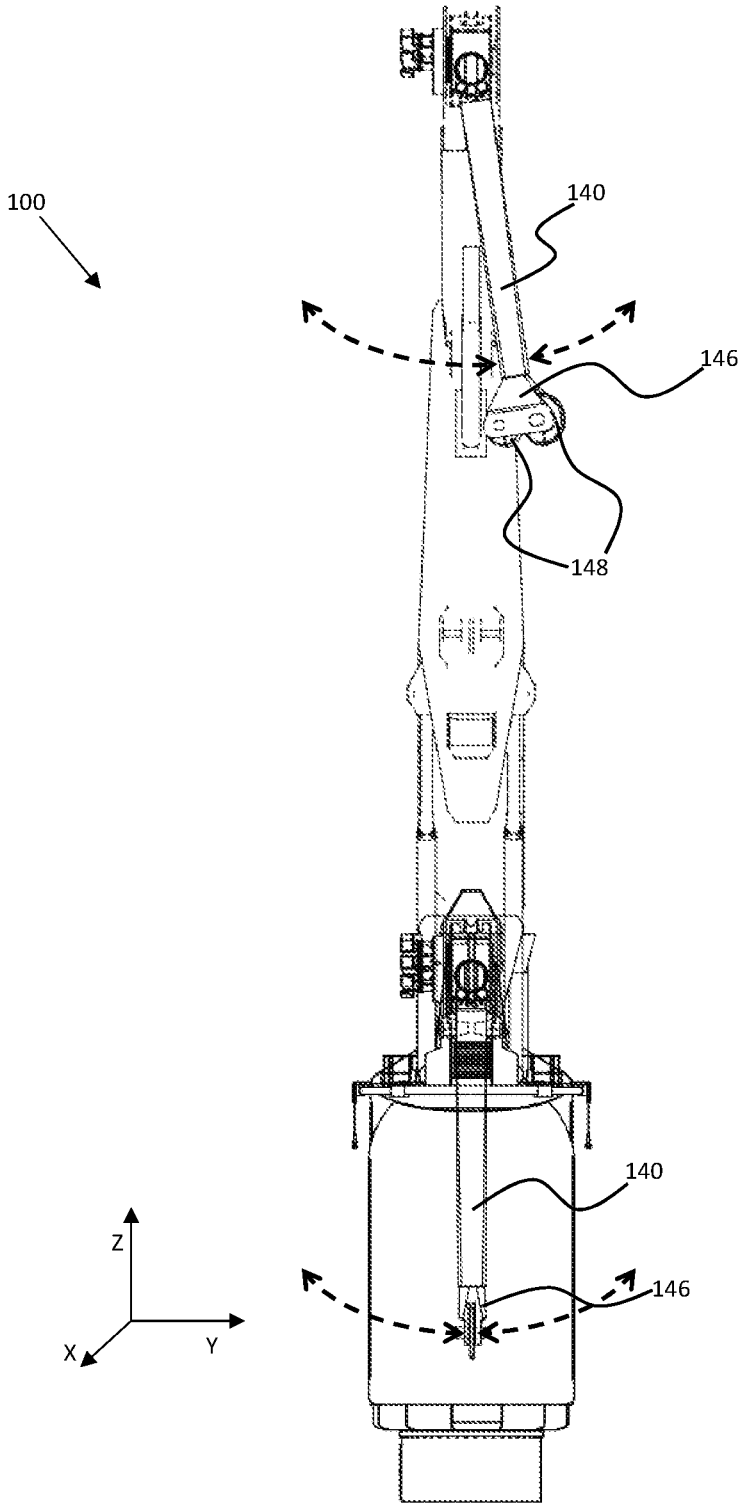
FIG. 14 illustrates a further aspect of the operation of the heave-compensated crane.

FIG. 14 illustrates a further aspect of the operation of the heave-compensated crane. In this case the heave-compensating boom 140 is actuated in the directions of the arrows within the Y-plane to compensate for position variations in the Y-direction due to heaves. An important aspect of this embodiment is that the rotating head 146 with the pair of sheaves 148 is now rotated with respect to the heave-compensating boom 140 to facilitate proper guiding of the hoisting cable (not shown) during these movements.

FIG. 15*a* shows an enlarged front view of the far-end of the main boom extension of the crane. FIG. 15*b* shows a cross-sectional view of FIG. 15*b*. These figures show some more details, which have been discussed but are harder to extract from the other drawings. As mentioned the heave-compensation boom 140 is the compensator part that will handle the sideways movement in relation to the crane boom orientation. The movement is held by an electrical or hydraulic system and it is done at the pivotable connection between the first arm 142 and the second arm 144. In this embodiment this interface is a slew bearing, gear ring or equivalent, which will facilitate the movement and handle the torques involved. The sideways movement may go up to 20°, both ways, depending on the loads applied. The rotatable/pivotable first arm 142 and the pivotable arm 144 together facilitate that the movement shape possibilities stay within a cone, because the base of the movement at the end of the heave-compensating boom 140 will be more or less a circle.

FIG. 16*a* shows an enlarged side view of the far-end of the main boom extension of the crane. FIG. 16*b* shows a further cross-sectional view of FIG. 16*a*. The first arm 142 will connect the crane boom 120, or main boom extension 122, in on end and connect the second arm 144 on the other end. The movement of the first arm will give a motion—forwards and backwards—in the same direction as the crane main boom orientation. Movement is driven electrically, or hydraulically, with the gearboxes carrying the movement while interacting with a gear ring, or equivalent, which may be installed on the side of the main sheave. This part of the system comprises a bigger sheave 128 with conical side shape to hold the side forces that occur due to 3D compensation. The first arm 142 will move in order to compensate the main boom 120, or main boom extension 122, up and down movements, by its own rotation.

FIG. 17 shows an enlarged view of the tip of the heave-compensating boom 140 of the crane, in particular the rotatable head 146. The rotatable head 146 intends to secure the hoisting cable (rope) position and gives its final support while the orientation is being given by the other two parts. The sheaves 148 have a smaller D:d than the main sheave 128, at the first arm 142, to support since there is no actual bending over these. The movement done by electrical, or hydraulic, actuators with the movement being carried by a slew bearing system, or equivalent. Both sheaves 148 have installed load cells (not shown), for overload safety, in order to get the amount of force felt by the head of the compensator. This rotation will ensure ±90° in relation to its stand by position (both sheaves 148 aligned with the main boom). The figure further illustrates actuators 147 inside the second arm 144 for rotating the rotatable head 146.

It has already been mentioned that this disclosure also relates to a heave-compensating crane no matter the method by which it is made. It is very well possible to build up such crane from the start. In that case the main boom extension may be dispensed with and a longer main boom may be manufactured and used.

Furthermore, there are many variations possible with respect to the example embodiments here discussed. For example, the heave-compensating crane of the disclosure can be made much bigger, with lifting capacities up to 2500 T, for instance when using parallel wire and parallel 3D compensator arms, with two or multipart blocks. Furthermore, the crane may be installed on a so-called A-FRAME.

All the movements may also, when possible, be carried with the help of a triangular centre positioning system. That will help the precision by getting the correct/updated coordinates in real time while lowering or lifting.

The particular embodiments disclosed above are illustrative only, as the disclosure may be modified and practiced in different but equivalent manners apparent to those skilled in the art having the benefit of the teachings herein. For example, the method steps set forth above may be performed in a different order. Furthermore, no limitations are intended to the details of construction or design herein shown, other than as described in the claims below. Accordingly, the protection sought herein is as set forth in the claims below.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage. In the device claim enumerating several means, several of these means may be embodied by one and the same item of hardware.

The invention claimed is:

1. Method of upgrading a knuckle-boom crane to a heave-compensating crane, the method comprising:

providing a knuckle-boom crane having a crane base, a main boom pivotably mounted to the crane base, and a knuckle-boom pivotably mounted to the main boom;

removing the knuckle-boom from the main boom;

mounting a main boom extension to the main boom for increasing the length of the main boom;

mounting a heave-compensating boom at a far end of the main boom extension such that the heave-compensating boom extends in a downward vertical direction (Z) in operational use of the heave-compensating crane, wherein the heave-compensating boom is configured to be pivotable with respect to the main boom extension in both horizontal directions (X, Y) defined with respect to the downward vertical direction (Z), and providing a heave-compensation system to the knuckle-boom crane comprising a plurality of actuators and the heave-compensating boom which is pivotable by at least one of the plurality of actuators, wherein the heave-compensation system is configured for compensating for horizontal variations by controlling the orientation of the heave-compensating boom relative to the main boom extension, and for compensating the vertical variations by means of a further vertical heave-compensation system which comprises a winch system configured for manipulating a hoisting cable to compensate the vertical variations.

2. The method according to claim 1, wherein, in mounting the main boom extension, the main boom extension comprises a top-sheave at a far end of the main boom extension.

3. The method according to claim 2, wherein, in mounting the heave-compensating boom, the heave-compensating boom comprises a hoisting cable guiding system for cooperating with the top-sheave.

4. The method according to claim 3, wherein the heave-compensating boom comprises a first end coupled to the main boom extension and a second end spaced apart from the first end, and wherein, in mounting the heave-compensating boom, the hoisting cable guiding system comprises a pair of sheaves mounted on a rotatable head provided at the second end of the heave-compensating boom.

5. The method according to claim 1, wherein, in mounting the heave-compensating boom, the heave-compensating boom comprises a first arm that is pivotably mounted to the main boom extension for allowing a rotation in a first horizontal direction (X), the heave-compensating boom further comprising a second arm that is pivotably mounted to the first arm for allowing a rotation in a second horizontal direction (Y) orthogonal to the first horizontal direction (X).

6. The method according to claim 5, wherein, in mounting the heave-compensating boom, the first arm is mounted such that the first arm extends in a substantially horizontal direction (X) in operational use of the heave-compensating crane, and the second arm is mounted such that the second arm extends in the downward vertical direction (Z) in operational use of the heave-compensating crane.

7. The method according to claim 5, wherein, in mounting the heave-compensating boom, said first and second arms are provided with electric or hydraulic actuators to control respective orientations of said arms.

8. The method according to claim 1, further comprising completion steps of completing the heave-compensating crane for making the heave-compensating crane ready for operational use, wherein the completion steps comprise the installation of the hoisting cable along the main boom, the main boom extension and the heave-compensating boom.

9. A heave-compensating crane comprising:

a crane base;

a main boom having a near end pivotably mounted to the crane base and a far end spaced apart from the near end, the main boom extending in a single linear direction along the entire length of the main boom;

a heave-compensating boom pivotably mounted at a far end of the main boom and having a first end pivotably coupled to the far end of the main boom and a second end coupled to a rotatable head, the length between the far end of the main boom and the second end of the heave-compensating boom being fixed, wherein the heave-compensating boom extends in a downward vertical direction (Z) in operational use of the heave-compensating crane, wherein the heave-compensating boom is configured to be pivotable with respect to the main boom in both horizontal directions (X, Y) defined with respect to the downward vertical direction (Z), a first heave-compensation system comprising a plurality of actuators, the rotatable head, and the heave-compensating boom which is pivotable by at least one of the plurality of actuators, and wherein the first heave-compensation system is configured for compensating for horizontal deviations by controlling the orientation of the heave-compensating boom relative to the main boom, and a second heave-compensation system comprising a winch system configured for manipulating a hoisting cable to compensate vertical deviations.

10. The heave-compensating crane according to claim 9, wherein the main boom comprises a top-sheave at the far end of the main boom.

11. The heave-compensating crane according to claim 10, wherein the heave-compensating boom comprises a hoisting cable guiding system for cooperating with the top-sheave.

12. The heave-compensating crane according to claim 11, wherein the hoisting cable guiding system comprises a pair of sheaves mounted on the rotatable head provided at the second end of the heave-compensating boom.

13. The heave-compensating crane according to claim 9, wherein the heave-compensating boom comprises a first arm that is pivotably mounted to the main boom for allowing a rotation in a first horizontal direction (X), the heave-compensating boom further comprising a second arm that is pivotably mounted to the first arm for allowing a rotation in a second horizontal direction (Y) orthogonal to the first horizontal direction (X).

14. The heave-compensating crane according to claim 13, wherein the first arm is mounted such that the first arm extends in a substantially horizontal direction (X) in operational use of the heave-compensating crane, and the second arm is mounted such that the second arm extends in the downward vertical direction (Z) in operational use of the heave-compensating crane.

15. The heave-compensating crane according to claim 13, wherein said first and second arms are provided with electric or hydraulic actuators to control respective orientations of said arms.

16. The heave-compensating crane according to claim 9 wherein the main boom comprises a first boom section joined to a second boom section at a joint, wherein the first boom section comprises the near end of the main boom and the second boom section comprises the far end of the main boom, and wherein the joint is configured to maintain the first and second boom sections extending in the single linear direction.

17. The heave-compensating crane according to claim 16, wherein the heave-compensating boom comprises a first arm that is pivotably mounted to the main boom for allowing a rotation in a first horizontal direction (X), the heave-compensating boom further comprising a second arm that is pivotably mounted to the first arm for allowing a rotation in a second horizontal direction (Y) orthogonal to the first horizontal direction (X).

18. The heave-compensating crane according to claim 17, wherein the first arm is mounted such that the first arm extends in a substantially horizontal direction (X) in operational use of the heave-compensating crane, and the second arm is mounted such that the second arm extends in the downward vertical direction (Z) in operational use of the heave-compensating crane.

19. The heave-compensating crane according to claim 17, wherein said first and second arms are provided with electric or hydraulic actuators to control respective orientations of said arms.

20. The heave-compensating crane according to claim 9 wherein the main boom comprises a plurality of boom sections joined together, and wherein the main boom is free of a knuckle-boom.

21. The heave-compensating crane according to claim 9 wherein the crane base comprises the second heave-compensation system.

22. The heave-compensating crane according to claim 9, wherein the main boom comprises a first boom section joined to a second boom section by an elongate mounting bar connected between the first boom section and the second boom section such that the first boom section is prevented from pivoting relative to the second boom section.

23. The heave-compensating crane according to claim 9, wherein the length between the first end of the heave-compensating boom and the rotatable head is fixed.

24. A heave-compensating crane comprising:

a crane base;

a main boom having a near end pivotably mounted to the crane base and a far end spaced apart from the near end, the main boom extending in a single linear direction along the entire length of the main boom; and a first heave-compensation system comprising a plurality of actuators and a first heave-compensating boom pivotably mounted at a far end of the main boom and having a first end pivotably coupled to the far end of the main boom and a second end coupled to a rotatable head, the length between the far end of the main boom and the second end of the heave-compensating boom being fixed, wherein the first heave-compensating boom is pivotable by at least one of the plurality of actuators and extends in a downward vertical direction (Z) in operational use of the heave-compensating crane, wherein the first heave-compensating boom is configured to be pivotable with respect to the main boom in both horizontal directions (X, Y) defined with respect to the downward vertical direction (Z);

wherein the first heave-compensating boom comprises a first arm that is pivotably mounted to the main boom for allowing a rotation in a first horizontal direction (X), the first heave-compensating boom further comprising a second arm that is pivotably mounted to the first arm for allowing a rotation in a second horizontal direction (Y) orthogonal to the first horizontal direction (X);

wherein the crane base comprises a second heave-compensation system comprising a winch system configured for manipulating a hoisting cable to compensate vertical deviations.

25. The heave-compensating crane according to claim 24 wherein the first arm is mounted such that the first arm extends in a substantially horizontal direction (X) in operational use of the heave-compensating crane, and the second arm is mounted such that the second arm extends in the downward vertical direction (Z) in operational use of the heave-compensating crane.

26. The heave-compensating crane according to claim 24, wherein the main boom comprises a first boom section joined to a second boom section by an elongate mounting bar connected between the first boom section and the second boom section such that the first boom section is prevented from pivoting relative to the second boom section.

27. The heave-compensating crane according to claim 24, wherein the length between the first end of the heave-compensating boom and the rotatable head is fixed.

* * * * *